United States Patent [19]

Hutchinson

[11] 4,415,100

[45] Nov. 15, 1983

[54] DRIP CATCH RESERVOIR

[76] Inventor: Robert S. Hutchinson, P.O. Box 938, 710 County Rd., Pocahasset, Mass. 02559

[21] Appl. No.: 331,043

[22] Filed: Dec. 16, 1981

Related U.S. Application Data

[63] Continuation-in-part of Ser. No. 137,181, Apr. 9, 1980, abandoned.

[51] Int. Cl.[3] ..... B65D 23/06

[52] U.S. Cl. ..... 222/108; 215/100.5

[58] Field of Search ..... 222/108, 109, 571; 220/DIG. 5; 215/100.5; 229/17 G; 239/120, 121, 122

[56] References Cited

U.S. PATENT DOCUMENTS

| | | | |
|---|---|---|---|
| 426,512 | 4/1890 | Parker | 239/121 |
| 866,807 | 9/1907 | Pitts | 222/108 |
| 2,002,677 | 5/1935 | Robinson | 222/108 |
| 2,156,747 | 5/1939 | Walker | 222/108 |
| 2,696,091 | 12/1954 | De Campos Bueno | 222/108 |
| 2,822,965 | 2/1958 | Smith | 222/571 |

FOREIGN PATENT DOCUMENTS

| | | | |
|---|---|---|---|
| 546966 | 8/1956 | Italy | 222/571 |

*Primary Examiner*—F. J. Bartuska

*Attorney, Agent, or Firm*—Howard I. Podell

[57] ABSTRACT

A catchment basin for containing drips of liquid that flow about the spout opening and down the sides of a liquid container when the container is fitted with the pouring position. The basin is preferably in the form of a collapsible corrugated open pocket that is fastened to a side of a container directly below the pouring spout. Alternatively the basin may be in the form of a portable open pocket which is fastened below a flat flexible shield section, the upper end of which is fixed to a circular collar of a size to fit snugly about a neck of a pouring spout of a container. The invention prevents drips of liquid falling to the bottom of a container which liquid drips conventionally contaminate the shelf of which a liquid container is stored and contaminates materials below such a shelf where the shelf is in the form of an open grill, such as in a refrigerator. Alternatively, upraised lip may be permanently formed on a container below the pouring spout of the container, with the lip in the form of an arcuate shape and of a triangular or a crescent shaped cross-section.

3 Claims, 10 Drawing Figures

DRIP CATCH RESERVOIR

This application is a continuation-in-part of application 137,181 filed on Apr. 9, 1980 by the same applicant, which prior application is now herewith abandoned.

SUMMARY OF THE INVENTION

My invention is a catchment basin for containing drips of liquid that flow about the spout opening and down the sides of a liquid container when the container is fitted in the pouring position. The basin is preferably in the form of a collapsible corrugated open pocket that is fastened to a side of a container directly below the pouring spout.

Alternatively the basin may be in the form of a portable open pocket which is fastened below a flat flexible shield section, the upper end of which is fixed to a circular collar of a size to fit snugly about a neck of pouring spout of a container. The invention prevents drips of liquid falling to the bottom of a container which liquid drips conventionally contaminate the shelf on which a liquid container is stored and contaminates materials below such a shelf where the shelf is in the form of an open grill, such as in a refrigerator.

Alternatively, an upraised lip may be permanently formed on a container below the pouring spout of the container, with the lip in the form of an arcuate shape and of a triangular or a crescent shaped cross-section.

My invention prevents the subsequent bacteria growth, excess odors and other effects of contamination from liquid drippings from opened containers as well as prevents liquid drippings from the container onto a table surface during pouring of a liquid from a container to a cup or glass resting on the table.

The corrugated pocket of the invention may be made of aluminum foil, wax covered paper or cardboard, plastic coated foil or plastic sheet and may be fixed to the external side of a carton by wax, glue, cement or epoxy materials. The corrugated pocket is expandable so as to stretch considerably away from the side of the container, during pouring of a liquid from a spout on the top of the container.

The portable embodiment of my invention may be readily attached to a conventional jug by slipping the collar of the pocket unit over the neck of the spout of the container.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
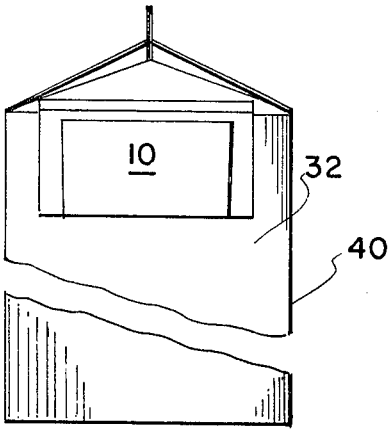
FIG. 1 is a front view of the invention installed on a rectangular container.
Figure 2:
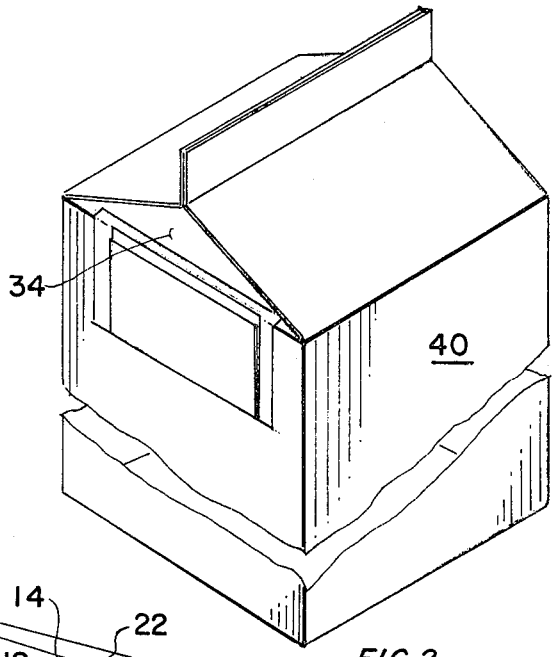
FIG. 2 is a perspective view of the invention of FIG. 1 in the folded closed position.
Figure 3:
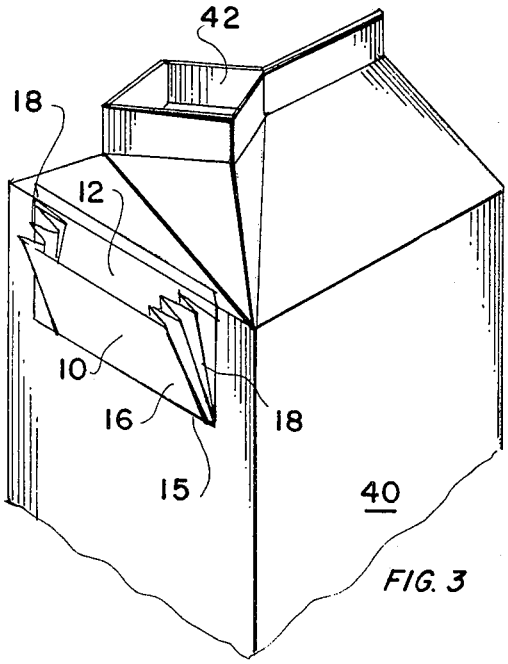
FIG. 3 is a perspective view of the invention of FIG. 1 in the unfolded open position.
Figure 4:
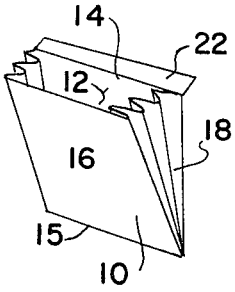
FIG. 4 is a perspective view of the invention of FIG. 1 prior to installation on a container.
Figure 8:
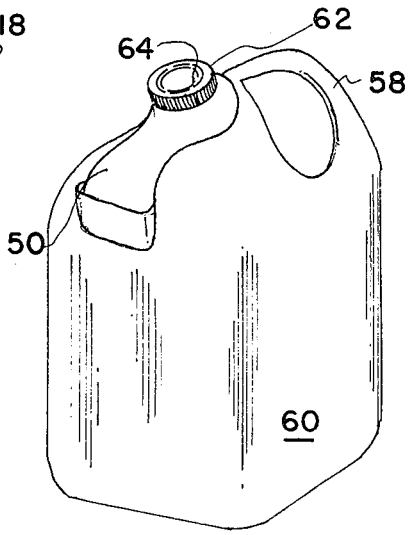
FIG. 8 is a perspective view of the invention of FIG. 5 installed on a jug.
Figure 5:
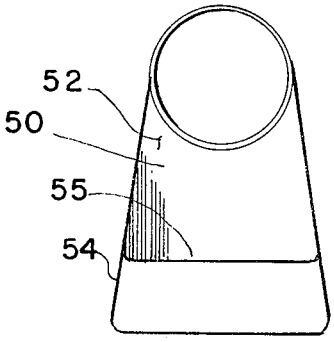
FIG. 5 is a plan view of a first alternative embodiment.
Figure 6:
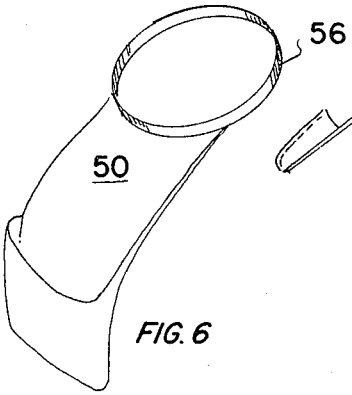
FIG. 6 is a perspective view of the invention of FIG. 5.
Figure 7:
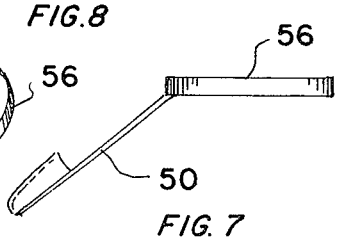
FIG. 7 is a side view of the invention of FIG. 5.

Turning now descriptively to the drawings, in which similar reference characters denote similar elements throughout the several views, FIGS. 1–4 illustrate an open pocket basin 10 which is formed of a flat sheet of material 12 which is folded to form a back side 14 joined by a bottom fold line 15 to a front side 16, with sides 14 and 16 joined at their respective sides by folded corrugations 18 so as to enclose an open compartment which is liquid tight along its bottom and sides.

A folded flap section 22 extends above the top edge of the back panel. The back surface of flap section 22 and back panel 12 may be coated with an adhesive such as wax, epoxy or cement, or other glue so as to adhere to the front side face 32 and front inclined top surface 34 of a conventional rectangular container such as a milk container 40, with the open mouth section of the device 10 located below the spout opening 42 of container 40. A separate unit 10 may be located on the opposite wall of the container 40 when the user may open a spout above said opposite wall.

The back surfaces of flap section 22 and panel 12 may be coated with a self-adhering adhesive so as to be fastened by the user to a carton 40, or carton 40 may be fitted with the invention device 10 prior to sale of the carton.

In use, any drippings from spout 42 will slip down inclined surface 34 into the interior of the open compartment of the device in which they will be retained. Front wall 16 of the device 10 may be extended a considerable distance away from container wall 32 so as to catch any drippings that might fall freely from the walls of spout 42 when the container 40 is being tilted towards or away from a cup.

FIGS. 5–8 illustrate an alternative embodiment 50 adaptable for attachment or removal from the neck section of a jug 60 that is fitted with a removable cap 62. The device 50 is in the form of a flat shaped shield section 52 formed along its bottom section into a pocket section 54 with a continuous mouth opening 55 along the top edge of the pocket section. The pocket section is sealed along its side and bottom to contain any liquid which drips down along the outer surface of shield section 52.

The upper edge of shield section 52 is joined to a collar 56 of a size to fit snugly about the neck section 64 of the spout opening 66 of jug 60. Collar 56 is of semi-flexible material and is readily squeezed into snug engagement about neck 64 by the cap 62 of the jug when cap 62 is fastened externally about neck 64. Preferably the device 50 is oriented so as to be opposite to handle 58 of the jug, with shield section 52 formed of semi-rigid material and shaped so as to rest pocket section 54 against the external surface of an attached jug, even when the attached jug is oriented along a diagonal axis, as when pouring liquid from the spout opening of the jug. If desired, collar 56 may be formed of shield section 52, but of a size to snugly fit about the neck 64 of a specific container jug 60.

When pouring liquids from container 60, any drippings from the spout opening will drip down upon shield section 52 into pocket 54 where they will be retained.

Figure 9:
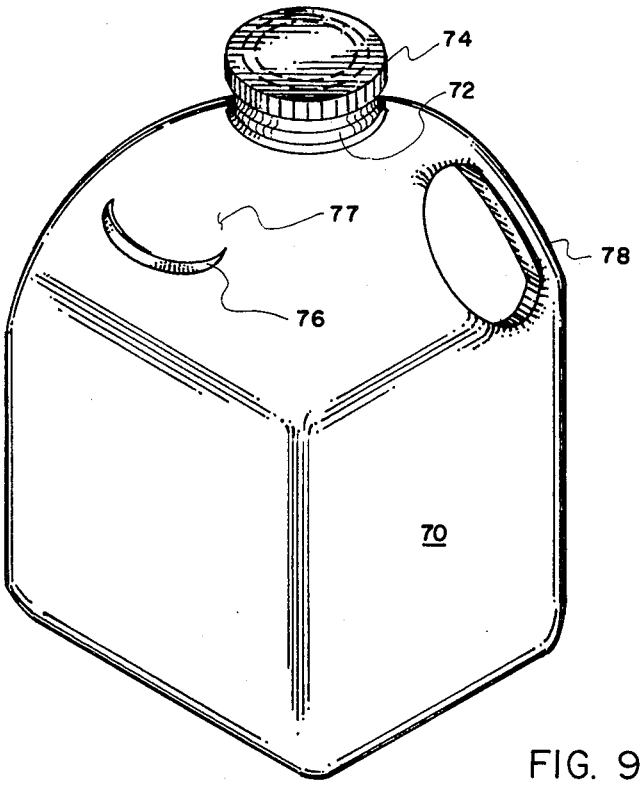
FIG. 9 is a perspective view of a second alternative embodiment of the invention.
Figure 10:
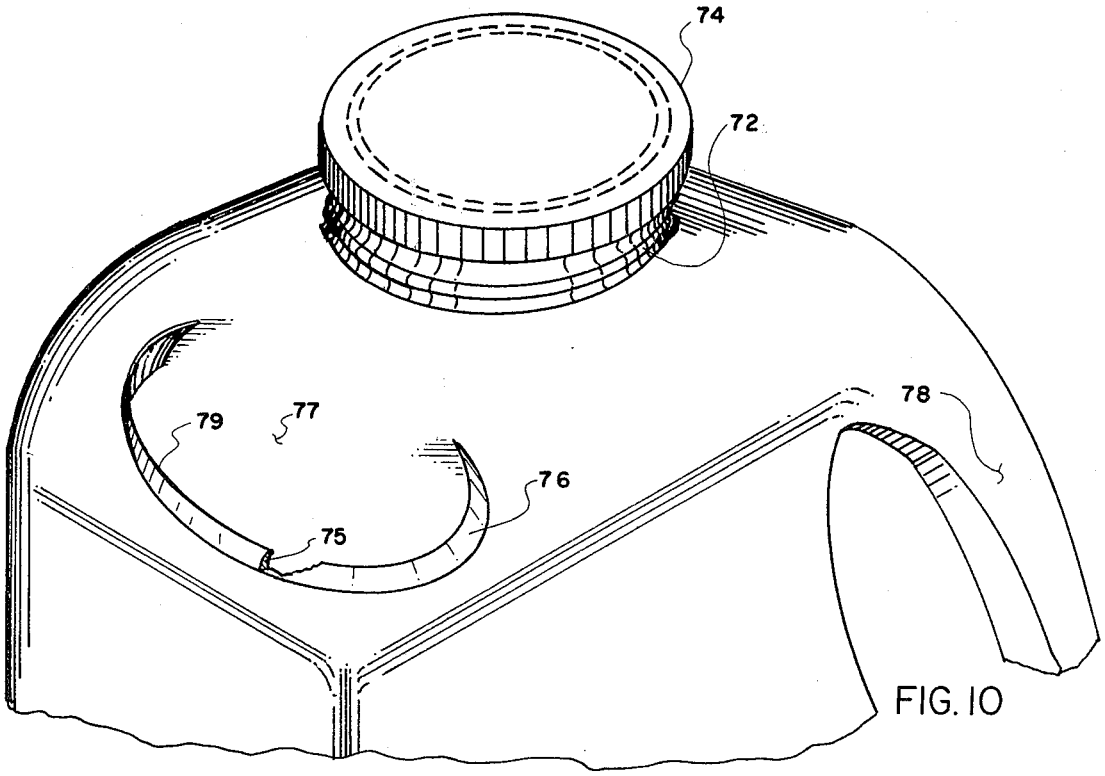
FIG. 10 is a detail view of the invention of FIG. 9.

FIG. 9 shows a second alternative embodiment of the invention in the form of a molded container 70 fitted with a handle 78 and a spout 72 closed by a threaded cap 74. A crescent shaped lip 76 projects from the container surface 77 directly below the spout 72 on a surface opposed to handle 78. As shown in FIGS. 9, 10, the upper surface 75 of lip 76 is shaped as a concave curve in cross-section, with the free end 79 of the lip pointing towards the spout 72 so as to retain drops of liquid caught by the lip when the container is slightly tilted with the spout upwards, in a pouring position. However, with the cap 74 placed on the spout 72, and with the container tilted so that the spout is pointing downwards, the liquid caught in the lip will freely pour out of the lip and fresh spray water may be employed to rinse off the upper surface of the lip.

Since obvious changes may be made in the specific embodiment of the invention described herein, such modifications being within the spirit and scope of the invention claimed, it is indicated that all matter container herein is intended as illustrative and not as limiting in scope.

Having thus described the invention, what I claim as new and desire to secure by Letters Patent of the United States is:

1. An expandable drip receptacle, comprising in combination:

sheet material including a flat section formed along its lower periphery in the shape of a foldable pocket open to its top, said pocket being of liquid-tight construction at least along its bottom and side sections, said pocket including sides forming corrugated folded sections to enable the front section of said pocket to be folded towards and away from said flat section;

said flat section having a top section, a flat foldable along said top section for fastening against an external surface of a liquid container below and adjacent a pouring spout of said container;

whereby drippings falling from said spout flow into said device.

2. The device of claim 1, wherein said material consists of aluminum foil, wax-covered paper or cardboard, plastic coated foil or plastic.

3. The device of claim 1, further including self-adhesive on the back of said flap and of said flat section.

* * * * *